US007820214B2

(12) United States Patent
Groenke

(10) Patent No.: US 7,820,214 B2
(45) Date of Patent: Oct. 26, 2010

(54) FOOD CONSUMPTION APPLIANCE

(76) Inventor: Dale Groenke, 2075 Old State Rd., Beaufort, MO (US) 63013

( * ) Notice: Subject to any disclaimer, the term of this patent is extended or adjusted under 35 U.S.C. 154(b) by 1363 days.

(21) Appl. No.: 11/048,651

(22) Filed: Jan. 26, 2005

(65) Prior Publication Data

US 2005/0172832 A1 Aug. 11, 2005

Related U.S. Application Data

(60) Provisional application No. 60/520,469, filed on Jan. 26, 2004.

(51) Int. Cl.
*B65D 81/32* (2006.01)

(52) U.S. Cl. ..... 426/115; 426/120; 426/112; 426/124; 426/119; 206/217; 206/541; 206/514; 220/501; 220/23.86; 220/23.87; 220/4.26; 220/4.27; 222/129; 222/145.1

(58) Field of Classification Search ..... 426/115, 426/394, 120, 112, 124, 119; 206/216, 217, 206/541, 514; 222/129, 145.3, 454, 481.5, 222/145.1; 220/421, 501, 527, 23.86, 23.87, 220/4.26, 4.27; 229/15
See application file for complete search history.

(56) References Cited

U.S. PATENT DOCUMENTS

| | | | | | |
|---|---|---|---|---|---|
| 2,740,575 | A * | 4/1956 | Fontaine | 229/103.1 |
| 3,288,344 | A * | 11/1966 | Woollen et al. | 229/103.1 |
| 4,069,940 | A | 1/1978 | Naimoll | |
| 4,558,804 | A | 12/1985 | Keck | |
| 5,706,980 | A * | 1/1998 | Dickerson | 222/129 |
| 6,003,711 | A * | 12/1999 | Bilewitz | 220/253 |
| 6,528,105 | B1 * | 3/2003 | Gerhart et al. | 426/394 |
| 2002/0114870 | A1 * | 8/2002 | Rebhorn et al. | 426/120 |
| 2002/0155202 | A1 * | 10/2002 | Rebhorn | 426/281 |
| 2002/0192338 | A1 * | 12/2002 | Ness et al. | 426/119 |
| 2004/0099544 | A1 * | 5/2004 | Ness et al. | 206/216 |
| 2004/0118709 | A1 * | 6/2004 | Cho | 206/219 |

* cited by examiner

*Primary Examiner*—Rena L Dye
*Assistant Examiner*—Chaim Smith
(74) *Attorney, Agent, or Firm*—Linda L. Lewis; Greensfelder, Hemker & Gale, P.C.

(57) ABSTRACT

A food consumption appliance having a first chamber and a second chamber, where the first chamber contains a liquid and the second chamber contains a dry comestible, where each chamber has an opening into a common mouthpiece so that when the appliance is tipped, the liquid and dry comestible exit into the mouthpiece.

8 Claims, 4 Drawing Sheets

Fig 5A
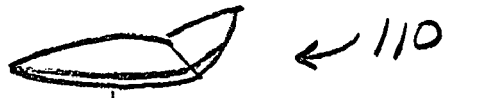
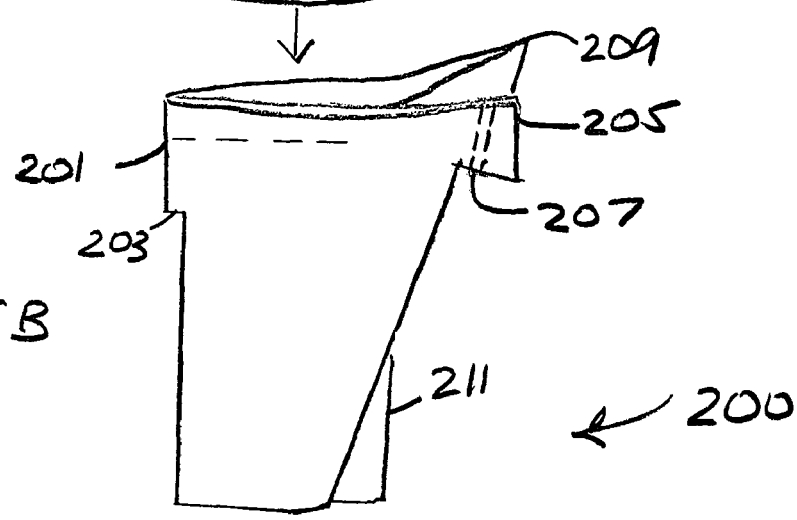
Fig. 5B
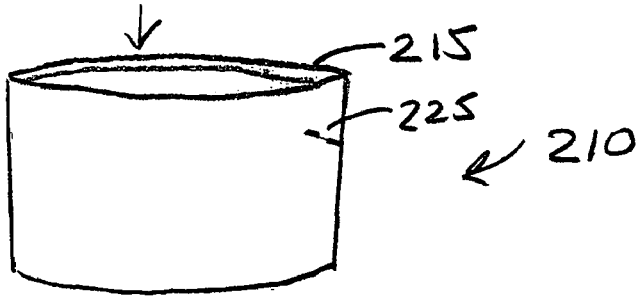
Fig. 5C
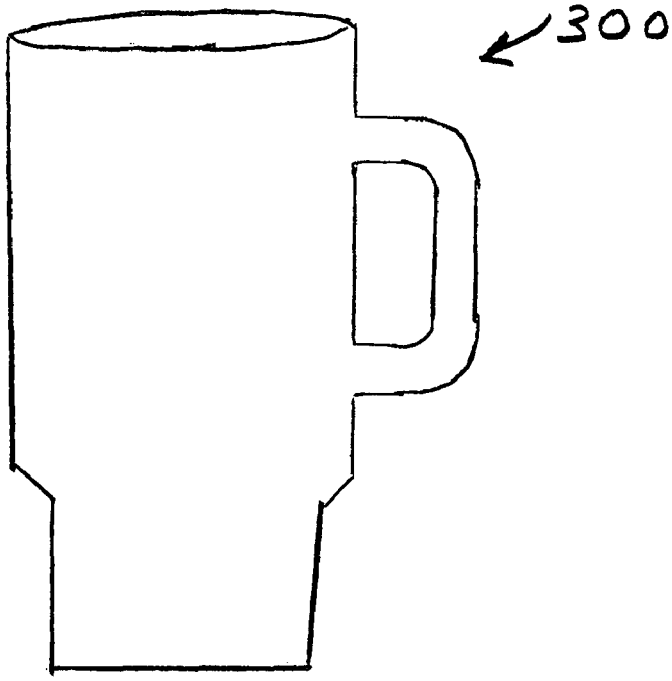
Fig. 5D

FOOD CONSUMPTION APPLIANCE

CROSS-REFERENCE TO RELATED APPLICATIONS

This application claims the benefit of U.S. Provisional Patent Application entitled "Food Consumption Appliance", Ser. No. 60/520,469, filed Jan. 26, 2004 which is incorporated by reference.

FIELD OF THE INVENTION

This invention relates to food consumption appliances, and, more particularly, to portable food consumption appliances for consuming dry comestibles and liquids.

BACKGROUND OF THE INVENTION

Various types of comestibles have a more pleasant taste when mixed or otherwise consumed with liquids. Certain foods, such as ready-to-eat cereals, are specifically manufactured with the intent of mixing the cereal with liquid, such as milk, prior to consumption. Typically, these foods become more palatable when a limited amount of liquid is absorbed by the dry cereal.

The process of combining liquids with dry comestibles can produce difficulties. The palatability of such combined foods is dependent on the amount of liquid absorbed by the food. For example, many ready-to-eat cereals are not particularly palatable when eaten dry, without any liquids. Correspondingly, the same cereal, having absorbed too much liquid, can become soggy and undesirable. This can happen if cereal is left sitting in milk too long. The best result is typically achieved when cereal is combined with the milk and eaten immediately.

It is sometimes desirable to eat breakfast "on-the-run", in a car or office. To have such a meal, the food must typically be "finger food", or food that can be held with one hand while it is consumed. To do this with a bowl of cold cereal is virtually impossible, because of the need to use a spoon with the bowl to retrieve the wetted cereal.

Various devices have been proposed to provide combine comestibles with liquids and provide a non-soggy mixture. In U.S. Pat. No. 4,558,804, a device is disclosed that has a lower liquid storage and an upper comestible storage that is compartmentalized and rotatable. At the desired time, the comestible in the upper storage is released into the lower storage where it mixes with the liquid and is consumed. Optionally, a spout can be extended into the liquid for withdrawing the liquid. This design, however, has the disadvantage of having the cereal drop down into the liquid, and then have to be withdrawn, which can be difficult when the cereal becomes soft or sticky.

A second patent addressing the mixing of cereal and milk is U.S. Pat. No. 4,069,940, which provides a two-part bowl that allows the user to place portions of the cereal into the milk as it is about to be consumed. This device, likewise, requires the use of a spoon or other device to retrieve the cereal from the bowl of milk, after it becomes soft or sticky.

Neither of the above-disclosed devices describes the claimed invention as herein described.

DISCLOSURE OF THE INVENTION

The present invention is a two-chambered device, wherein the first chamber is water-tight and is suitable for containing a liquid. The second chamber is suitable for containing a dry comestible. The first and second chambers each have at least one opening to a common mouthpiece, wherein the liquid and the dry comestible exit the first and second chambers through the mouthpiece, and are consumed in the mouth. The dry comestible is wetted with the liquid as it enters the mouthpiece. In one embodiment, the present invention can physically resemble a travel cup, which has a generally cylindrical shape, wherein the first chamber is formed by a larger outer cup, and the second chamber is formed by a smaller inner cup, which nests in the larger cup. The upper lip of the smaller cup forms a seal with the upper lip of the larger cup. The first and second chambers open into a common tapered mouthpiece for consuming the dry comestible and liquid. About 180° above the mouthpiece on the upper lip of the larger cup is a small vent hole to allow air to enter the sealed chamber as the liquid is consumed. Optionally, the smaller cup has a ramp which allows the dry comestible to flow freely into the mouth at the common mouthpiece as the device is tipped back to consume the liquid and dry comestible.

BRIEF DESCRIPTION OF THE DRAWINGS

An embodiment of the invention is given in the following drawings:

FIGS. 5A through 5D are a side-view of the assembling of the components to form a third embodiment of the food consumption appliance.

A DESCRIPTION OF THE BEST MODE OF THE INVENTION

The principles of the invention are disclosed, by way of example, in a food consumption appliance 100. The consumption appliance 100 is adapted for use with dry comestibles, such as cold cereal. The appliance 100 allows the consumer to consume milk and cold cereal, using a device resembling a travel cup, by tipping the appliance 100 up to his lips and allowing the milk and cereal to flow out of the appliance into his mouth. The cereal and milk are mixed and consumed in the mouth without the use of a spoon or other tool to retrieve the cereal from a bowl or cup. The appliance 100 allows cold cereal to be consumed using only one hand, and allows the cereal to be consumed before it becomes soggy from sitting in milk too long.

Figure 1:
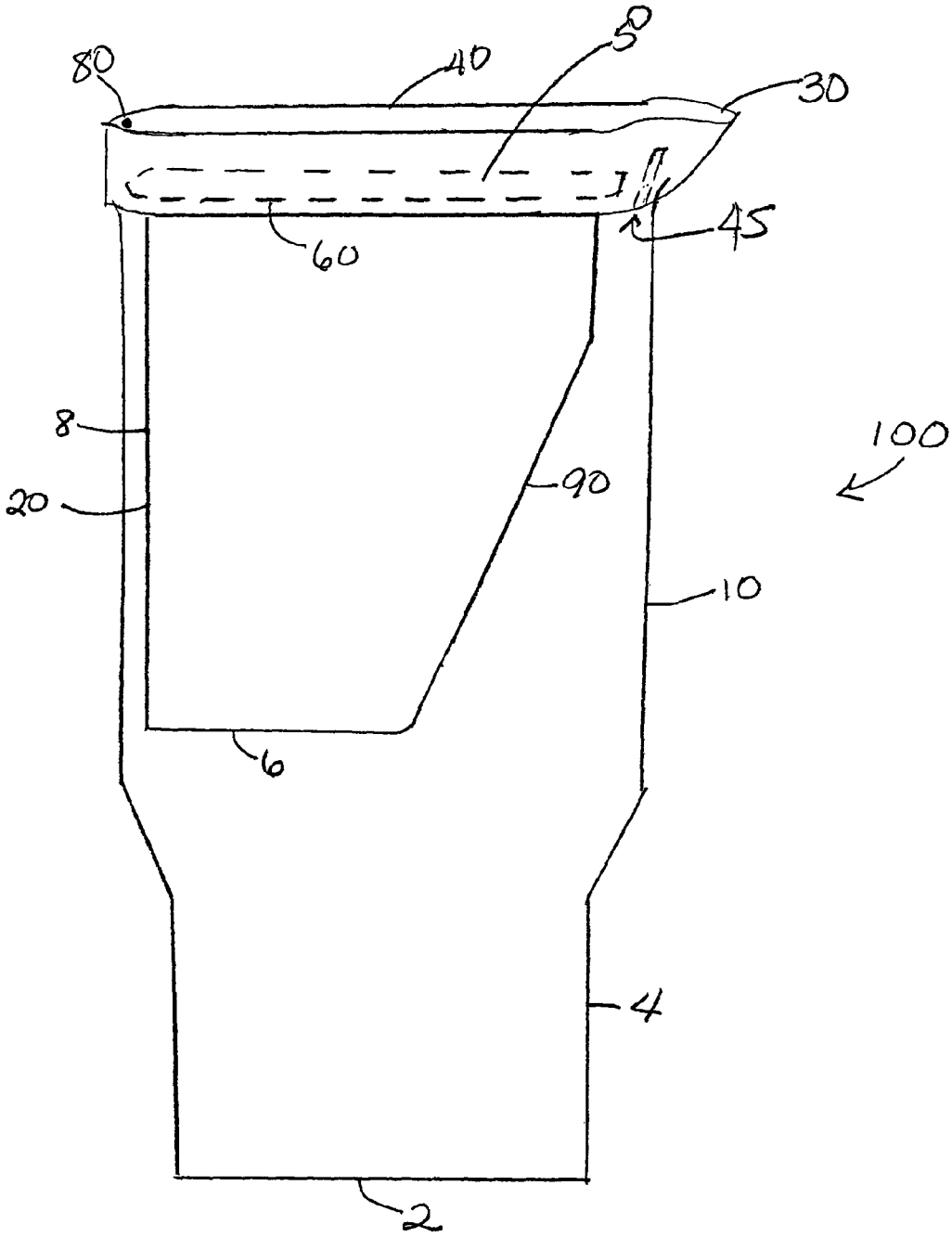
FIG. 1 is a sectional side view of the food consumption appliance.

Referring to FIG. 1, the appliance 100 has a first chamber which, in this embodiment, is a larger cup 10. The larger cup can be cylindrical with a circular base portion 2 and a vertically-disposed cylindrical portion 4 extending upwards from the base 2. The larger cup 10 can be filled with a liquid, such as milk, to any desired level necessary to provide liquid to the consumer. Additionally, the appliance 100 has a second chamber, which in this embodiment is a smaller cup 20 that nests in the first chamber 10. The smaller cup 20 has a bottom 6 and side 8 that is vertically-disposed. Optionally, the smaller cup 20 has a ramp 90 that is directed to a mouth-piece 30, so that when the appliance is tipped to deliver liquid and dry cereal, the cereal slides quickly down the ramp 90 through the opening 50 into the consumer's mouth. The smaller cup 20 has an upper lip 40 that engages with the upper lip of the first chamber (not shown) thereby forming a seal 60 between the two cups, so that when the appliance is tipped and liquid is dispensed from the first chamber 10 through the first opening 45, no liquid leaks from the appliance. The seal can be formed from the tight fit of the smaller cup 20 into the larger cup 10 or by the use of sealing means such as gaskets or O-rings.

Figure 2:
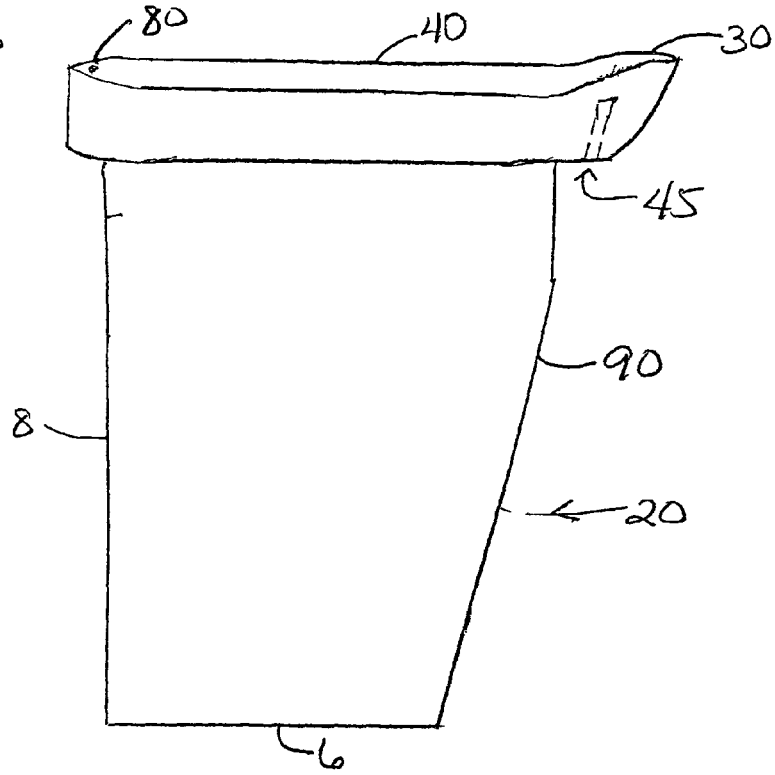
FIG. 2 is a side view of the inner cup of the food consumption appliance.

Referring to FIG. 2, which is a side view of the smaller cup 20, the upper lip of the smaller cup 40 has an opening 45 allowing the liquid contents of the larger cup 10 to flow to the mouthpiece 30. When the appliance is tipped, the liquid in the larger cup 10 can flow over the mouthpiece 30 and into the mouth of the consumer.

Figure 3:
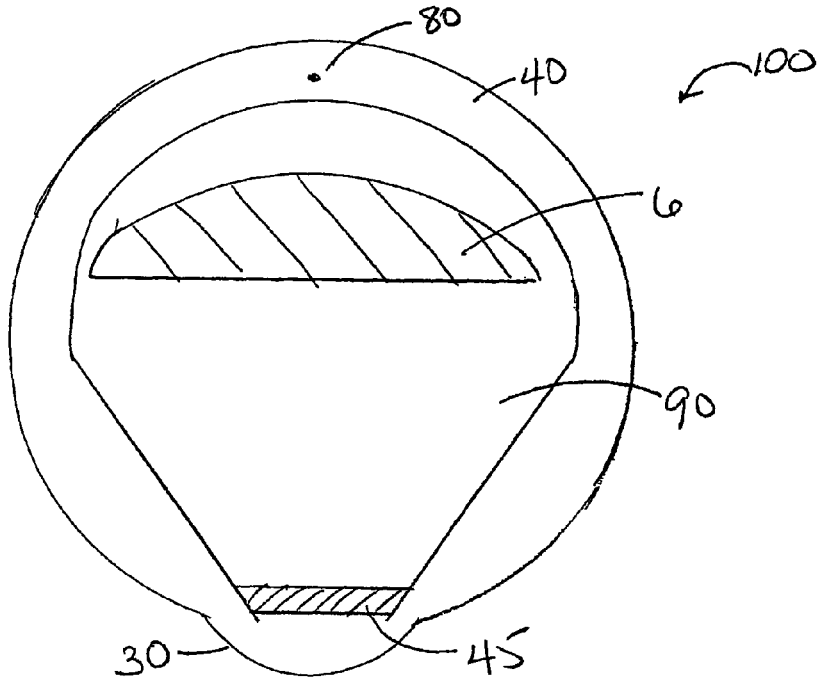
FIG. 3 is an elevated top view of the food consumption appliance.

Referring to FIG. 3, the mouthpiece 30 has an opening 45 that allows the milk to flow out of the larger cup 10. The mouthpiece 30 extends outwardly from the upper lip of the smaller cup 40 and can be rounded or curved upward. The effect of the mouthpiece 30 is to direct the liquid and the dry comestible it the mouth easily, so that the liquid and solid do not spill rather than go into the mouth for consumption. The opening 45 is designed to deliver the desired flow of liquid into the mouth when the appliance is tipped. Optionally, the appliance has a lid (not shown) which fits on top of the upper lip of the small cup 40, but is open at the mouthpiece 30, so that the dry comestibles are covered, but the mouthpiece 30 is uncovered, allowing the food and liquid to be eaten. Further, optionally, the lid has a removable closure that covers and seals the entire top of the smaller cup 20, which is removed when the consumer desires to eat the food and liquid.

Figure 4:
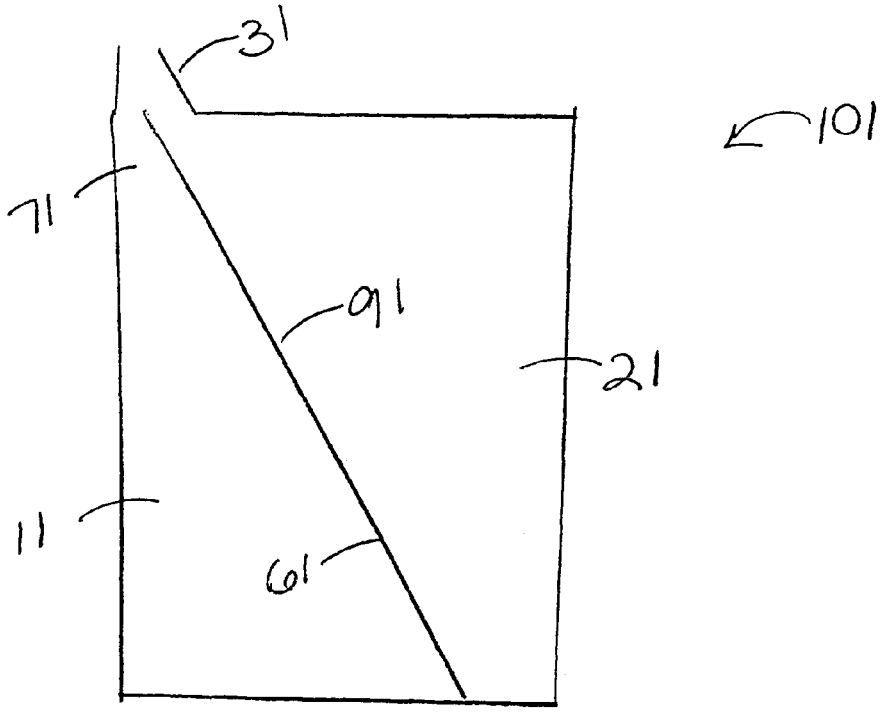
FIG. 4 is a sectional side view of a second embodiment of the food consumption appliance.

Referring to FIG. 4, the appliance 101, in a second embodiment has a first chamber 11 and a second chamber 21. The appliance 101 can be a disposable or recyclable box made of materials such as paper or plastic that are waterproof and air tight. The first chamber 11 contains a liquid, and can be made from materials such as plastic or foil-lined paper. The second chamber 21 is contiguous with the first chamber 11, and the seal, 61 between the first chamber 11 and the second chamber 21 is a shared wall made of similar materials as is the rest of the box. Alternatively, chambers 11 and 21 can be individually prepared plastic bags or boxes that have been inserted into the larger box. Optionally, appliance 101 has a ramp 91 that provides an incline for the dry comestible to slide into the consumer's mouth. In the present embodiment, the ramp 91 and the seal 61 are the same part. The appliance 101 has a mouthpiece 31, which can extend from the appliance 101, so that the lips of the consumer can engage the mouthpiece 31 when the appliance 101 is tipped back and the liquid and food are not spilled. Optionally, the mouthpiece 31 has a removable seal that opens the mouthpiece 31 and allows the food and liquid to be consumed.

FIGS. 5A through 5D illustrate the assembling of a third embodiment of the present invention. Referring to FIG. 5D, is a side view of larger cup 300. Cup 300 can be a commercially available travel cup with a handle. Referring to FIG. 5C, which nests inside 5D, is an adapter 210, whose outer portion friction seals with the interior of cup 300. At the top of the adapter is the female portion of a snap ring 215 which seals with the male portion of the snap ring 205 on the inner cup 200. On the interior of the adapter 210 is a protrusion 225 which aligns with opening 207 of the inner cup 200. Said protrusion is used to modulate the flow of liquid by partially or completely aligning with the opening by rotating the inner cup 200.

Referring to FIG. 5B, the inner cup 200 has an extended ridge 209 at the tip of the mouthpiece to stop the liquid from dripping when the cup is tipped away from the mouth after consuming the liquid and comestible. At the bottom of the cup 200 is a foot which allows the cup to stand up-right as it is filled with dry comestible. At the back of cup 200 is an air hole 203 which allows air to enter cup 300 as liquid is withdrawn. Referring to FIG. 5A, a snap on lid 110 provides a sanitary cover of the contents for transportation, and further, by partially opening the lid, the flow of the contents of the appliance is limited and controlled. The lid 110 snaps onto the cup 200 at the shelf 201 and is secure there.

An advantage of the third embodiment is that a commercially available cup can be used, and that the appliance can be disassembled and washed in a dishwasher or by hand, and is therefore reusable.

The present invention includes, but is not limited variations of the present embodiment. The appliance may have at least one handle to hold the appliance when using. The appliance may have insulation to keep the contents cold or hot. The appliance may be made of dishwasher safe materials, such as high density polyethylene and be re-useable. The appliance may be made of materials that are disposable or recyclable. The appliance may be stored in the refrigerator or the freezer until ready to use. The contents may be sterilized and sealed to as to be store on the shelf at room temperature and not be refrigerated or frozen. The appliance may be decorated, or embellished with logos or symbols of companies or sports teams. In an additional embodiment, the first chamber, containing the comestible is separate from the second chamber. It is prepared as a sealed unit and stored accordingly. At the time of consumption, the first chamber is inserted into and sealed with the second chamber containing liquid, and the liquid and dry comestible are consumed.

The size of the appliance is not critical. However, it is noted that typical servings of cold cereal are typically 8 ounces with 6 ounces of milk. The appliance can be sized accordingly.

The invention claimed is:

1. A food consumption appliance comprising:

a first chamber and a second chamber, said first chamber having at least one opening to a common mouthpiece; said second chamber having at least two openings to said common mouthpiece, wherein at least one opening is between said mouthpiece and said first chamber, and at least one opening is between said second chamber and said mouthpiece, said first chamber contains a liquid, said second chamber contains a dry comestible; when said appliance is tipped, said liquid and said dry comestible exit said first chamber and said second chamber respectively into said mouthpiece; said first chamber is in the form of a cup, and between said first chamber and said second chamber there is an adapter sealing said first chamber and said second chamber together; said adapter having an inner circumferal surface being configured with a protrusion on said adapter's inner circumferal surface; said protrusion extending inwardly towards the center of both chambers and arranged such that upon rotation of said second chamber the size of the at least one opening between said mouthpiece and said first chamber in said second chamber is regulated to increase or decrease the flow of liquid through said second chamber opening into said common mouthpiece.

2. The food consumption appliance of claim 1 wherein the liquid is milk and the dry comestible is cold cereal.

3. The food consumption appliance of claim 1 wherein said appliance has a snap on lid partially covering and sealing said second chamber, wherein said lid is configured to allow dispensing of said liquid and said dry comestible through said common mouthpiece when said appliance is tipped.

4. A food consumption appliance comprising:

a first chamber and a second chamber, said first chamber having at least one opening to a common mouthpiece; said second chamber having at least two openings to said common mouthpiece; wherein at least one opening is between said mouthpiece and said first chamber, and at least one opening is between said second chamber and said mouthpiece, said first chamber contains milk, said second chamber contains a dry cold cereal; when said appliance is tipped, said mild and said dry cereal exit said first chamber and said second chamber respectively into said mouthpiece; said first chamber is in the form of a cup and between said first chamber and said second chamber there is an adapter sealing said first chamber and said second chamber together; said adapter having an inner circumferal surface being configured with a protrusion on said adapter's inner circumferal surface; said protrusion extending inwardly towards the center of both chambers and arranged such that upon rotation of said second chamber the size of the at least one opening between said mouthpiece and said first chamber in said second chamber is regulated to increase or decrease the flow of liquid through said second chamber opening into said common mouthpiece.

5. The food consumption appliance of claim 4, wherein said appliance has a snap on lid partially covering and sealing said second chamber, wherein said lid is configured to allow dispensing of said liquid and said dry comestible through said common mouthpiece when said appliance is tipped.

6. The food consumption appliance of claim 4, wherein said second chamber further comprises an air hole leading from said second chamber into said first chamber.

7. The food consumption appliance of claim 1 wherein said second chamber further comprises a ramp inclined so as to allow said dry comestible to slide more readily to said mouthpiece.

8. The food consumption appliance of claim 1, wherein the first chamber comprises insulated materials suitable for keeping foods hot or cold.

* * * * *